US008439153B2

(12) United States Patent
Hudson et al.

(10) Patent No.: US 8,439,153 B2
(45) Date of Patent: May 14, 2013

(54) METHOD AND APPARATUS FOR A LOUDSPEAKER ASSEMBLY

(75) Inventors: Michael Hudson, Nashville, NC (US); William C Stewart, Jr., Raleigh, NC (US); Larry Frerichs, Raleigh, NC (US)

(73) Assignee: RGB Systems, Inc., Anaheim, CA (US)

( * ) Notice: Subject to any disclaimer, the term of this patent is extended or adjusted under 35 U.S.C. 154(b) by 0 days.

(21) Appl. No.: 13/564,947

(22) Filed: Aug. 2, 2012

(65) Prior Publication Data

US 2012/0294472 A1 Nov. 22, 2012

Related U.S. Application Data

(63) Continuation of application No. 13/023,345, filed on Feb. 8, 2011, now Pat. No. 8,276,706, which is a continuation-in-part of application No. 12/949,607, filed on Nov. 18, 2010, now Pat. No. 8,127,885, which is a continuation of application No. 12/355,730, filed on Jan. 16, 2009, now Pat. No. 7,866,438, which is a continuation-in-part of application No. 12/163,929, filed on Jun. 27, 2008, now Pat. No. 7,861,825.

(51) Int. Cl.
*H04R 1/02* (2006.01)

(52) U.S. Cl.
USPC ..... 181/148; 181/150; 181/199

(58) Field of Classification Search ..... 181/148, 181/150, 199
See application file for complete search history.

(56) References Cited

U.S. PATENT DOCUMENTS 1,967,223 A * 7/1934 Bostwick ..... 181/173
2,917,127 A * 12/1959 Elliott ..... 181/151
3,143,182 A * 8/1964 Sears et al. ..... 181/153
3,941,207 A * 3/1976 Croup ..... 181/199
3,993,345 A * 11/1976 Croup ..... 296/37.16
4,029,170 A * 6/1977 Phillips ..... 181/155
4,071,111 A * 1/1978 Croup ..... 181/149
4,131,179 A * 12/1978 Pope ..... 181/156
4,147,229 A * 4/1979 Flashman ..... 181/144
4,215,761 A * 8/1980 Andrews ..... 181/152
4,301,889 A * 11/1981 Tralonga ..... 181/145
4,437,539 A * 3/1984 Festa ..... 181/145
4,439,643 A * 3/1984 Schweizer ..... 381/395
4,550,429 A * 10/1985 Burbank et al. ..... 381/368
4,939,783 A * 7/1990 Dunning ..... 381/386
5,113,968 A * 5/1992 Lemmon ..... 181/148
5,143,339 A * 9/1992 Ashcraft et al. ..... 248/343
5,147,986 A * 9/1992 Cockrum et al. ..... 181/145
5,266,752 A * 11/1993 Cussans ..... 181/155
5,278,361 A * 1/1994 Field ..... 181/145

(Continued)

*Primary Examiner* — Jeremy Luks

(74) *Attorney, Agent, or Firm* — The Hecker Law Group, PLC

(57) ABSTRACT

The present invention relates to a loudspeaker assembly and a method of assembling a loudspeaker assembly. In one or more embodiments, the invention comprises forming a front baffle comprising a first driver mounting portion, an intermediate portion, and an edge mounting portion. A first driver is installed in the first driver mounting portion proximate to a first driver aperture. A rear baffle is formed from a second material, which, in one or more embodiments, is less stiff than the first material from which the front baffle is formed. The rear baffle comprises a top portion, sidewalls, a recessed mounting portion, and an edge portion. The edge mounting portion of the front baffle is attached to the recessed mounting portion of the rear baffle such that an entirety of said front baffle is recessed within said rear baffle spaced apart from said open bottom portion.

14 Claims, 8 Drawing Sheets

U.S. PATENT DOCUMENTS

| | | | | |
|---|---|---|---|---|
| 5,532,437 | A * | 7/1996 | Simplicean et al. | 181/150 |
| 5,731,551 | A * | 3/1998 | Petrucci | 181/150 |
| 5,739,481 | A * | 4/1998 | Baumhauer et al. | 181/148 |
| 6,005,957 | A * | 12/1999 | Meeks | 381/386 |
| 6,035,962 | A * | 3/2000 | Lin | 181/199 |
| 6,259,798 | B1 * | 7/2001 | Perkins et al. | 381/397 |
| 6,675,930 | B2 * | 1/2004 | Sugiyama et al. | 181/148 |
| 6,744,902 | B2 * | 6/2004 | Proni | 381/386 |
| 6,944,312 | B2 * | 9/2005 | Mason et al. | 381/391 |
| 7,032,708 | B2 * | 4/2006 | Popken et al. | 181/150 |
| 7,073,624 | B2 * | 7/2006 | Decanio et al. | 181/150 |
| 7,120,269 | B2 * | 10/2006 | Lowell et al. | 381/386 |
| 2003/0123679 | A1 * | 7/2003 | Dudleston et al. | 381/87 |
| 2004/0094358 | A1 * | 5/2004 | Peng | 181/199 |
| 2004/0218777 | A1 * | 11/2004 | Hagman | 381/386 |
| 2005/0098378 | A1 * | 5/2005 | Shea | 181/150 |
| 2005/0259841 | A1 * | 11/2005 | Caron et al. | 381/345 |

* cited by examiner

METHOD AND APPARATUS FOR A LOUDSPEAKER ASSEMBLY

CROSS-REFERENCE TO RELATED APPLICATIONS

This patent application is a continuation of U.S. patent application Ser. No. 13/023,345 filed Feb. 8, 2011, which is a continuation in part of U.S. patent application Ser. No. 12/949,607 filed Nov. 18, 2010 which issued as U.S. Pat. No. 8,127,885 on Mar. 6, 2012, which is a continuation of U.S. patent application Ser. No. 12/355,730 filed Jan. 16, 2009 which issued as U.S. Pat. No. 7,866,438 on Jan. 11, 2011, which is a continuation in part of U.S. patent application Ser. No. 12/163,929 filed Jun. 27, 2008 which issued as U.S. Pat. No. 7,861,825 on Jan. 4, 2011, each of which is incorporated by reference in its entirety herein.

BACKGROUND OF THE INVENTION (1) Field of the Invention

The present invention relates to a loudspeaker assembly and a method for assembling a loudspeaker assembly.

(2) Description of the Related Art

Loudspeakers are transducers that convert electrical energy to mechanical energy. Loudspeaker assemblies are typically designed to satisfy physical constraints, including electrical and mechanical constraints. The degree to which such constraints are satisfied can affect the acoustic performance of the loudspeaker assemblies. When loudspeaker assemblies are installed in a surface, such as a ceiling, it is desirable for the installed loudspeaker assemblies to maintain existing properties of the surface, such as strength, fire resistance, seismic stability, and aesthetics. Further, when installed in ceilings, reducing the weight of a loudspeaker assembly is desirable.

U.S. Pat. No. 6,944,312, issued to Mason et al., describes a lightweight loudspeaker enclosure that includes a back box having a peripheral edge, a grille that is crimped around the peripheral edge of the back box, and a baffle sheet disposed between the back box and the grille, the baffle sheet having an opening for placement of a loudspeaker. The baffle sheet is described as preferably being made of vinyl or thin MYLAR and is said to act to prevent sound waves from reentering the loudspeaker enclosure.

U.S. Pat. No. 7,120,269, issued to Lowell et al., describes a lay-in tile type system for supporting loudspeakers in a new or existing suspended ceiling. The system is described as having a plate that provides a solid surface for installation of one or more loudspeakers, with a back box optionally mounted over the loudspeaker and secured by nuts.

Prior art systems are not described as integrating a speaker driver as a structural support member for the loudspeaker assembly and providing structural support through a single point of attachment, while also being capable of maintaining desired properties, such as strength, fire resistance, acoustics, aesthetics and light weight.

BRIEF SUMMARY OF THE INVENTION

The present invention relates to a loudspeaker assembly and a method of assembling a loudspeaker assembly. In one or more embodiments, the invention comprises forming a front baffle from a first material, the front baffle comprising a first driver mounting portion, an intermediate portion, and an edge mounting portion. A first driver aperture is formed in the first driver mounting portion, and a port aperture is formed in the intermediate portion. A first driver is installed in the first driver mounting portion by mounting the first driver proximate to the first driver aperture. A rear baffle is formed from a second material, which, in one or more embodiments, is the same as the first material from which the front baffle is formed. In one or more embodiments, the first material is stiffer than the second material. In one or more embodiments, the first material is less stiff than the second material. In one or more embodiments, the rear baffle comprises a top portion, sidewalls, a recessed mounting portion, and an edge portion. The edge mounting portion of the front baffle is attached to the recessed mounting portion of the rear baffle. In one or more embodiments, a back box is placed over the rear baffle. In one or more embodiments, the back box provides thermal insulation. In one or more embodiments, the back box complies with fire protection requirements, such as fire codes or industry standards, such as Intertek or UL standards. In one or more embodiments, an electrical assembly is installed in the loudspeaker assembly, for example in an electrical compartment formed in the rear baffle. In one or more embodiments, the rear baffle is secured to the back of the first driver, such that the driver acts as a structural member that increases the rigidity of the loudspeaker assembly. In one or more embodiments, a mounting plate is provided for securely attaching the first driver to a structural support thereby securely attaching the entire loudspeaker assembly to the structural support. One or more apertures are formed in the rear baffle and in the back box to allow the mounting plate to attach to the first driver via a fastener that passes though the rear baffle and the back box. In one or more embodiments, a perforated grille is crimped to the edge portion of the rear baffle and an edge portion of the back box.

BRIEF DESCRIPTION OF THE DRAWINGS

The present invention may be understood and its features made apparent to those skilled in the art by referencing the accompanying drawings.

The use of the same reference symbols in different drawings indicates similar or identical items.

DETAILED DESCRIPTION OF THE INVENTION

Figure 1:
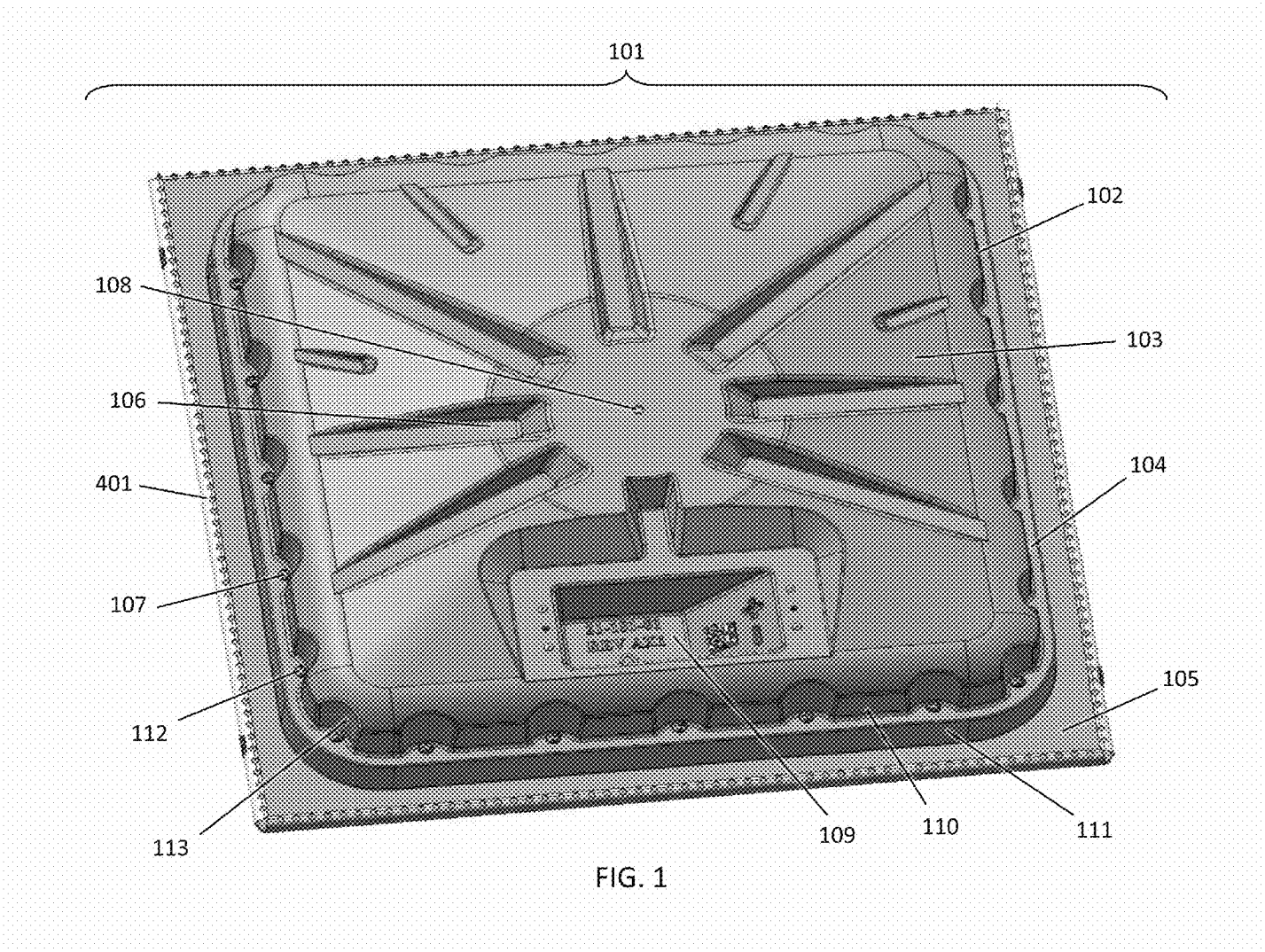
FIG. 1 is an axonometric projection of a loudspeaker assembly in accordance with at least one embodiment, as viewed from a rear perspective.

A loudspeaker assembly and a method for assembling a loudspeaker assembly are disclosed. In one or more embodiments, a front baffle is formed from a first material so as to comprise a first driver mounting portion, an intermediate portion, and an edge mounting portion. In one or more embodiments, the first material is medium density fibreboard ("MDF"). In one or more embodiments, the first material is polyethylene, for example, high molecular weight polyethylene ("HMWPE"). In one or more embodiments, the first material is ABS. A first driver aperture is formed in the first driver mounting portion, and a port aperture is formed in the intermediate portion. A first driver is mounted proximate to the first driver aperture. A rear baffle is formed from a second material so as to comprise a top portion, sidewalls, a recessed mounting portion, and an edge portion. The second material may be the same as or different from the first material. In one or more embodiments, the second material is polyethylene, for example, HMWPE. In one or more embodiments, the second material is MDF. In one or more embodiments, the second material is ABS. In one or more embodiments, the first material is HMWPE and the second material is MDF. In one or more embodiments, the first material is MDF and the second material is HMWPE. Using MDF for one of the front and rear baffles and HMWPE for the other of the front and rear baffles provides a lighter overall weight than using MDF for both baffles and provides greater rigidity than using HMWPE for both baffles. The edge mounting portion of the front baffle is attached to the recessed mounting portion of the rear baffle. In one or more embodiments, a perforated grille is applied to the edge portion of the rear baffle. In one or more embodiments, the grille is fastened to the rear baffle by crimping the edges of the grille around the edge portion of the rear baffle.

In one or more embodiments, the front baffle comprises a second driver mounting portion. A second driver aperture is formed in the second driver mounting portion, and a second driver is mounted proximate to the second driver aperture. In one or more embodiments, the loudspeaker assembly has a frequency response of approximately 50 Hz-20,000 Hz. In one or more embodiments, the first driver is a woofer having a frequency response of approximately 80 Hz-3,000 Hz and the second driver is a tweeter having a frequency response of approximately 3,000 Hz-20,000 Hz. In one or more embodiments, the loudspeaker assembly comprises an active or passive crossover network that directs lower audio frequencies to one driver and higher audio frequencies to the other driver. In one or more embodiments, the loudspeaker assembly comprises a transformer, an amplifier, a digital audio interface connected to a computer network, a radio receiver, a volume control, or any other assembly of electronics suitable for connection to one or more drivers.

In accordance with at least one embodiment, a back box is placed over and attached to the rear baffle. In one or more embodiments, the back box provides thermal insulation. In one or more embodiments, the back box complies with fire protection requirements, such as fire codes. In one or more embodiments, the back box provides an additional acoustic barrier, preventing sound from traveling out of the back of the speaker enclosure. In one or more embodiments, an electrical assembly is installed in the loudspeaker assembly, for example in a recessed compartment formed in the rear baffle. In one or more embodiments, the recessed compartment houses electrical and/or electronic components, such as electrical terminals, a transformer, an amplifier, attenuators, volume controls, tone controls, active or passive crossover networks, a digital audio interface connected to a computer network, a radio receiver, or any other assembly of electronic and/or electrical devices or components.

In one or more embodiments, a grille is installed over the front of the loudspeaker assembly.

In one or more embodiments, the first driver is used as a structural member that increases the rigidity of the loudspeaker assembly. In one or more embodiments, the rear baffle is secured to the rear of the first driver, while the front of the first driver is secured to the front baffle. In such embodiments, the first driver acts as a structural member tying the front and rear baffles together and thereby increasing the rigidity of the loudspeaker assembly.

In accordance with at least one embodiment, a mounting plate is provided for securely attaching the first driver to a structural support, thereby securely attaching the entire loudspeaker assembly to the structural support. In one or more embodiments, the mounting plate comprises a seismic mounting plate that complies with seismic building codes. In one or more embodiments, apertures are formed in the rear baffle and in the back box to allow the mounting plate to attach to the first driver via a fastener that passes though the rear baffle and the back box. The mounting plate is thus able to attach the first driver to a structural support outside the loudspeaker assembly. In one or more embodiments, the first driver is securely mounted to the remainder of the loudspeaker assembly. Accordingly, securing the first driver to a structural support also secures the entire loudspeaker assembly to the structural support.

FIG. 1 is an axonometric projection of a loudspeaker assembly 101 in accordance with at least one embodiment, as viewed from a rear perspective. Loudspeaker assembly 101 comprises a rear baffle 102 that comprises a top portion 103, a first sidewall 110, a recessed mounting portion 104, a second sidewall 111, and an edge portion 105. In the embodiment of FIG. 1, rear baffle 102 comprises stiffening ribs 106 integrally formed in top portion 103. In one or more embodiments, ribs 106 increase the stability and rigidity of rear baffle 102. In one or more embodiments, ribs 106 are arranged in a symmetric, radial pattern around the center of rear baffle 102. Recessed mounting portion 104 forms an internal peripheral mounting surface to which a front baffle is mounted in one or more embodiments, as described below. First sidewall 110 is disposed on one side of recessed mounting portion 104, and second sidewall 111 is deposed on a second side of recessed mounting portion 104. Recessed mounting portion 104 comprises a plurality of mounting holes 107. In one or more embodiments, scalloped edges 113 are formed in first sidewall 110. Scalloped edges 113 increase the stability and rigidity of rear baffle 102 and form a larger surface area in recessed mounting portion 104 to accommodate mounting holes 107. In one or more embodiments, mounting holes 107 are used to mount rear baffle 102 to a front baffle with screws 112 that pass through mounting holes 107 and screw into the front baffle. Alternatively, rivets, nuts and bolts, or any other type of fastener may be used.

In accordance with at least one embodiment, rear baffle 102 comprises an aperture 108. As described below, aperture 108 allows the attachment of a mounting plate to a first driver located within loudspeaker assembly 101. In accordance with at least one embodiment, aperture 108 is ¼ inch in diameter to accommodate a ¼ inch screw 507.

In accordance with at least one embodiment, top portion 103 of the rear baffle 102 comprises a recessed compartment 109. In one or more embodiments, recessed compartment 109 comprises a recessed cavity appropriately sized to accommodate one or more electrical and/or electronic components, which may comprise electrical terminals, a transformer, an amplifier, attenuators, volume controls, tone controls, active or passive crossover networks, a digital audio interface connected to a computer network, a radio receiver, or any other electrical or electronic circuits or components.

In accordance with at least one embodiment, rear baffle 102 is formed of a polymer material, such as polyethylene (for example HMWPE), polypropylene, acrylonitrile butadiene styrene (ABS), or any other suitable polymer. Rear baffle 102 may be vacuum thermoformed or formed by any other process now known or later discovered. Alternatively, rear baffle 102 may be formed of a composite material, such as glass reinforced plastic, MDF, carbon fiber reinforced plastic or aramid fiber reinforced plastic, a metal, such as aluminum alloy, or any other appropriate material. In accordance with at least one embodiment, rear baffle 102 is formed of 3/16 inch thick HMWPE, but the thickness of the material of rear baffle 102 may be varied in accordance with the properties of the material and desired physical and mechanical properties, such as weight and stiffness.

Figure 2:
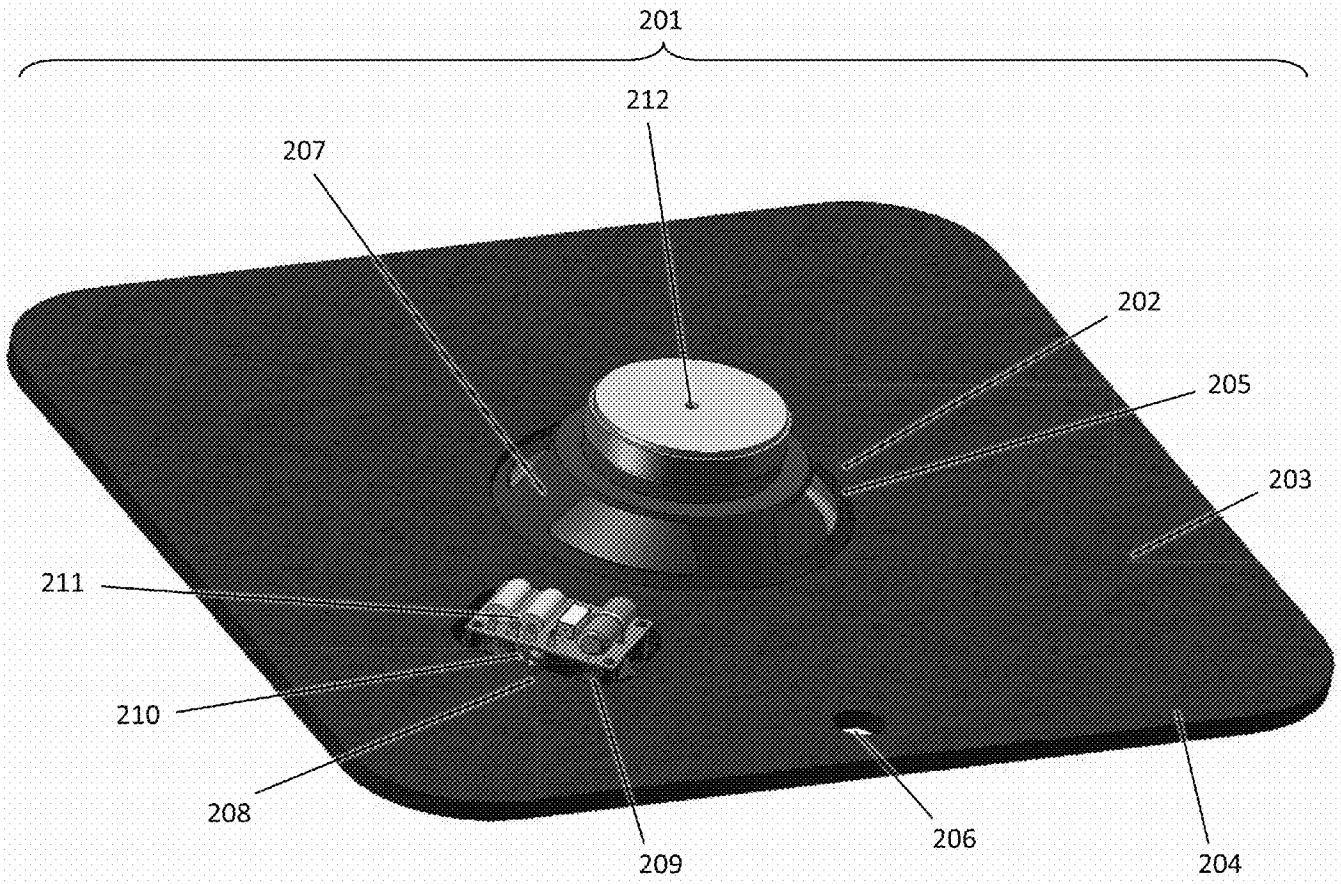
FIG. 2 is an axonometric projection of a loudspeaker assembly in accordance with at least one embodiment, as viewed from a rear perspective.

FIG. 2 is an axonometric projection of a front baffle 201 in accordance with at least one embodiment, as viewed from a rear perspective. In the embodiment of FIG. 2, front baffle 201 comprises a first driver mounting portion 202, an edge mounting portion 204, and an intermediate portion 203 between first driver mounting portion 202 and edge mounting portion 204. First driver mounting portion 202 comprises a first driver aperture 205. A first driver 207 is mounted to first driver mounting portion 202 by mounting first driver 207 proximate to first driver aperture 205. In one or more embodiments, first driver 207 is mounted to first driver mounting portion 202 using suitable fasteners, such as, for example, screws, nuts and bolts, rivets and/or adhesives such that first driver 207 is firmly and securely attached to front baffle 201. In one or more embodiments, first driver 207 comprises an attachment mechanism 212 that can be used to secure first driver 207 to an external support, as described below. In one or more embodiments, attachment mechanism 212 comprises a ¼ inch by 20 TPI threaded hole.

In accordance with at least one embodiment, a front baffle 201 comprises a second driver mounting portion 208. A second driver aperture 209 is formed in second driver mounting portion 208, and a second driver 210 is mounted to second driver mounting portion 208 by mounting second driver 210 proximate to second driver aperture 209 using suitable fasteners, such as, for example, screws, nuts and bolts, rivets and/or adhesives. In one or more embodiments, an electronic circuit board 211 is attached to second driver 210. In one or more embodiments, electronic circuit board 211 is attached to either front baffle 201 or rear baffle 102. In one or more embodiments, electronic circuit board 211 is disposed in recessed compartment 109 of rear baffle 102. Electronic circuit board 211 may contain an active or passive crossover network that directs lower audio frequencies to the first driver and higher audio frequencies to the second driver. Alternatively, electronic circuit board 211 may contain a transformer, an amplifier, a digital audio interface connected to a computer network, a radio receiver, a volume control, or any other assembly of electronics suitable for connection to first driver 207 and/or second driver 210.

In accordance with at least one embodiment, a port aperture 206 is formed in the intermediate portion 203 of front baffle 201. In one or more embodiments, port aperture 206 is configured to form a resonant system with the other elements of speaker assembly 101 so as to improve the acoustic properties of speaker assembly 101. In one or more embodiments, port aperture 206 is generally circular in shape. In one or more embodiments, port aperture 206 is rectangular in shape. In one or more embodiments, port aperture 206 is oval in shape. In one or more embodiments, port aperture 206 is polygonal in shape. In one or more embodiments, port aperture 206 has an irregular shape. In one or more embodiments, front baffle 201 comprises multiple port apertures 206.

In accordance with at least one embodiment, front baffle 201 is formed of medium density fiberboard (MDF). In one or more embodiments, front baffle 201 is cut to the appropriate size and shape from commercially available MDF stock, but front baffle 201 may be formed by any process now known or later discovered. In one or more embodiments, front baffle 201 is formed of a polymer material, such as polyethylene (for example HMWPE), polypropylene, acrylonitrile butadiene styrene (ABS), or any other suitable polymer. In one or more embodiments, front baffle 201 is vacuformed, but may be formed by any process now known or later discovered. In one or more embodiments, front baffle 201 is formed of natural wood, engineered wood, composite materials, or any other suitable material. In one or more embodiments, front baffle 201 is formed from a material that is stiffer than the material used to form rear baffle 102. In one or more embodiments, front baffle 201 is formed from a material that is less stiff than the material used to form rear baffle 102. In one or more embodiments, front baffle 201 is formed from a material that is equally as stiff as the material used to form rear baffle 102. In accordance with at least one embodiment, front baffle 201 is formed of ½ inch thick MDF, but the thickness of the material of front baffle 201 may be varied in accordance with the properties of the material and desired physical and mechanical properties, such as weight and stiffness. In one or more embodiments, rear baffle 102 is formed of 3/16 inch thick HMWPE and front baffle 201 is formed of ½ inch thick MDF.

Figure 3:
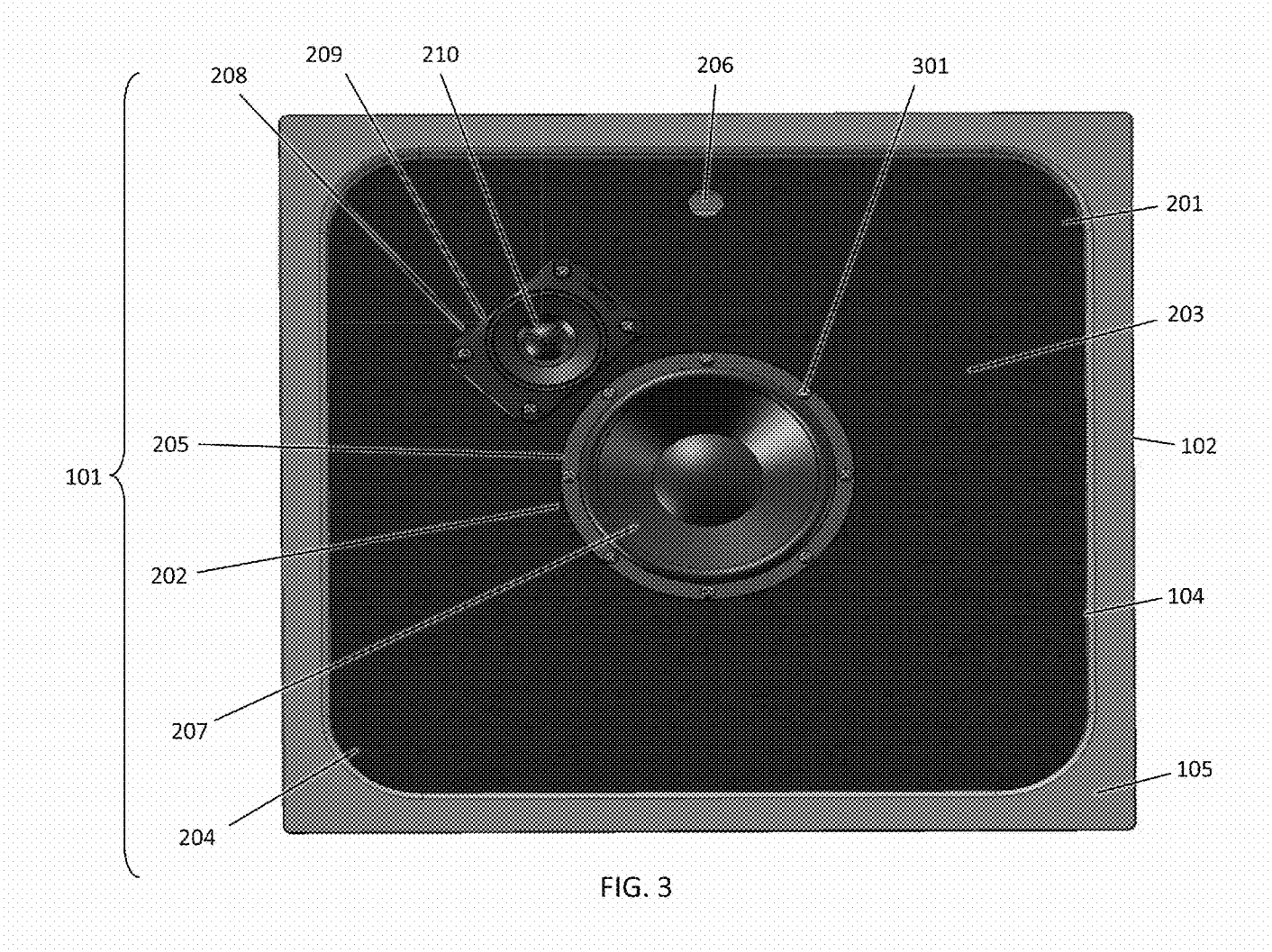
FIG. 3 is a plan view of a loudspeaker assembly in accordance with at least one embodiment, as viewed from a front perspective.

FIG. 3 is a plan view of a loudspeaker assembly in accordance with at least one embodiment, as viewed from a front perspective. In the embodiment of FIG. 3, first driver 207 and second driver 210 are attached to front baffle 201 with screws 301. Alternatively, the drivers may be attached to front baffle 201 with rivets, nuts and bolts or any other type of fastener, adhesive, or by any other suitable attachment method. Edge mounting portion 204 of front baffle 201 is attached to recessed mounting portion 104 of rear baffle 102. In one or more embodiments, front baffle 201 is attached to rear baffle 102 with screws 112 through mounting holes 107 that are screwed directly into front baffle 201. Alternatively, front baffle 201 may be attached to rear baffle 102 with rivets, nuts and bolts or any other type of fastener, adhesive, by welding, or by any other suitable attachment method.

In one or more embodiments, first driver 207 acts as a structural member that further secures rear baffle 102 to front baffle 201. In one or more embodiments, first driver 207 comprises an attachment mechanism 212 that is used to secure rear baffle 102 to first driver 207, and hence to front baffle 201. In one or more embodiments, attachment mechanism 212 comprises a threaded hole in the magnet structure of first driver 207. In one or more embodiments, rear baffle 102 is secured to attachment mechanism 212 of first driver 207 by means of a bolt that passes through aperture 108 of rear baffle 102 and is threaded into attachment mechanism 212 of first driver 207.

Figure 4:
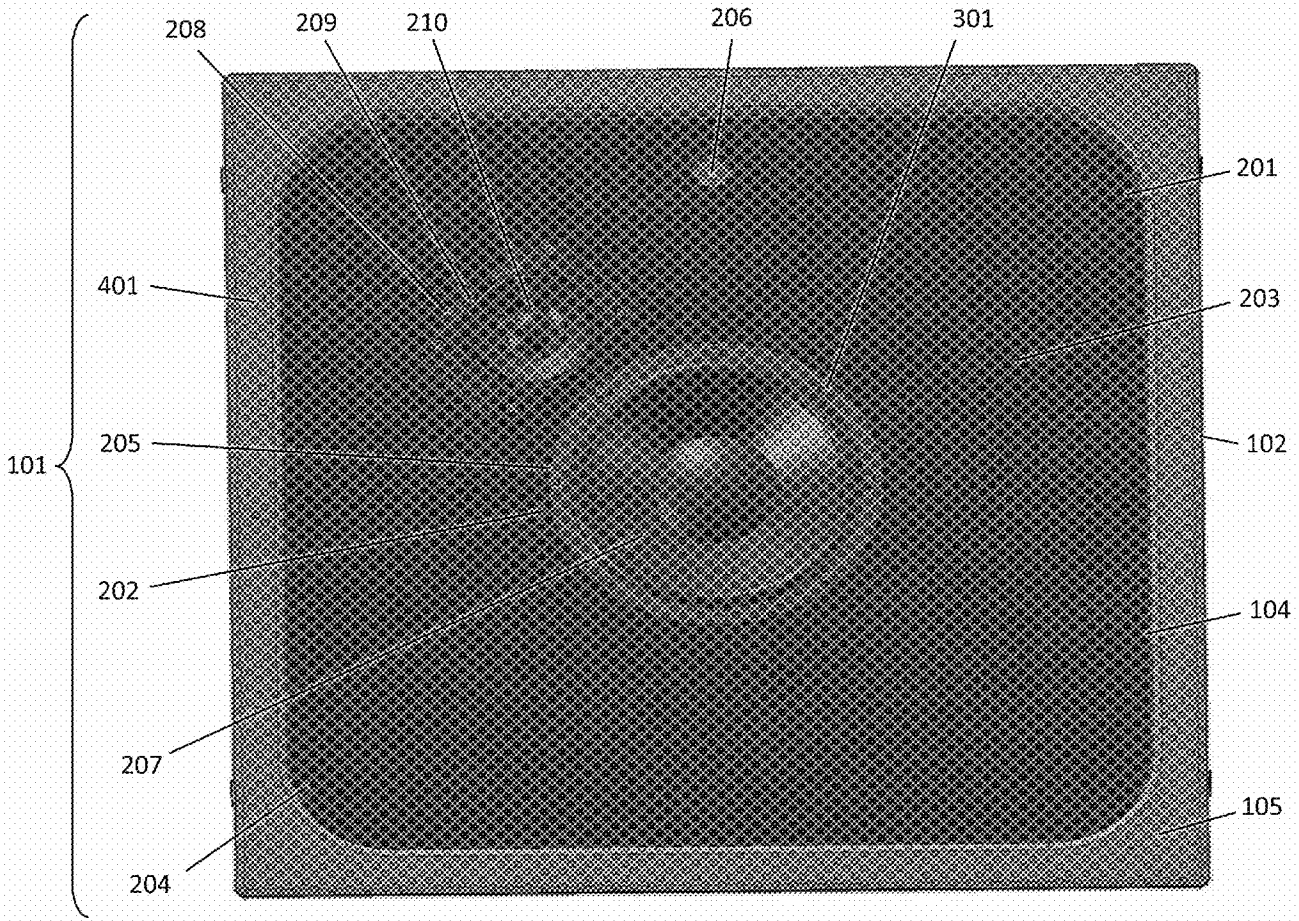
FIG. 4 is a plan view of a loudspeaker assembly in accordance with at least one embodiment, as viewed from a front perspective.

FIG. 4 is a plan view of a loudspeaker assembly in accordance with at least one embodiment, as viewed from a front perspective. In the embodiment of FIG. 4, a perforated grille 401 is disposed over the front portion of loudspeaker assembly 101. In one or more embodiments, grille 401 comprises a pattern of perforations in the grille. In one or more embodiments, grille 401 is fastened to loudspeaker assembly 101 by crimping the edges of grille 401 about edge portion 105 of rear baffle 102. Alternatively, grille 401 may be fastened to loudspeaker assembly 101 with rivets, screws, nuts and bolts, adhesive, by welding, or by any other suitable attachment method.

In accordance with at least one embodiment, grille 401 is formed of steel. Alternatively, grille 401 may be formed of aluminum alloy or other metals, a polymer material, composite materials, or any other suitable material. In accordance with at least one embodiment, grille 401 is a standard 2 foot by 2 foot air return grille of the type commonly used in heating, ventilation, and air conditioning (HVAC) systems. In one or more embodiments, grill 401 is any standard size imperial or metric air return grill of the type commonly used in HVAC systems.

Figure 5:
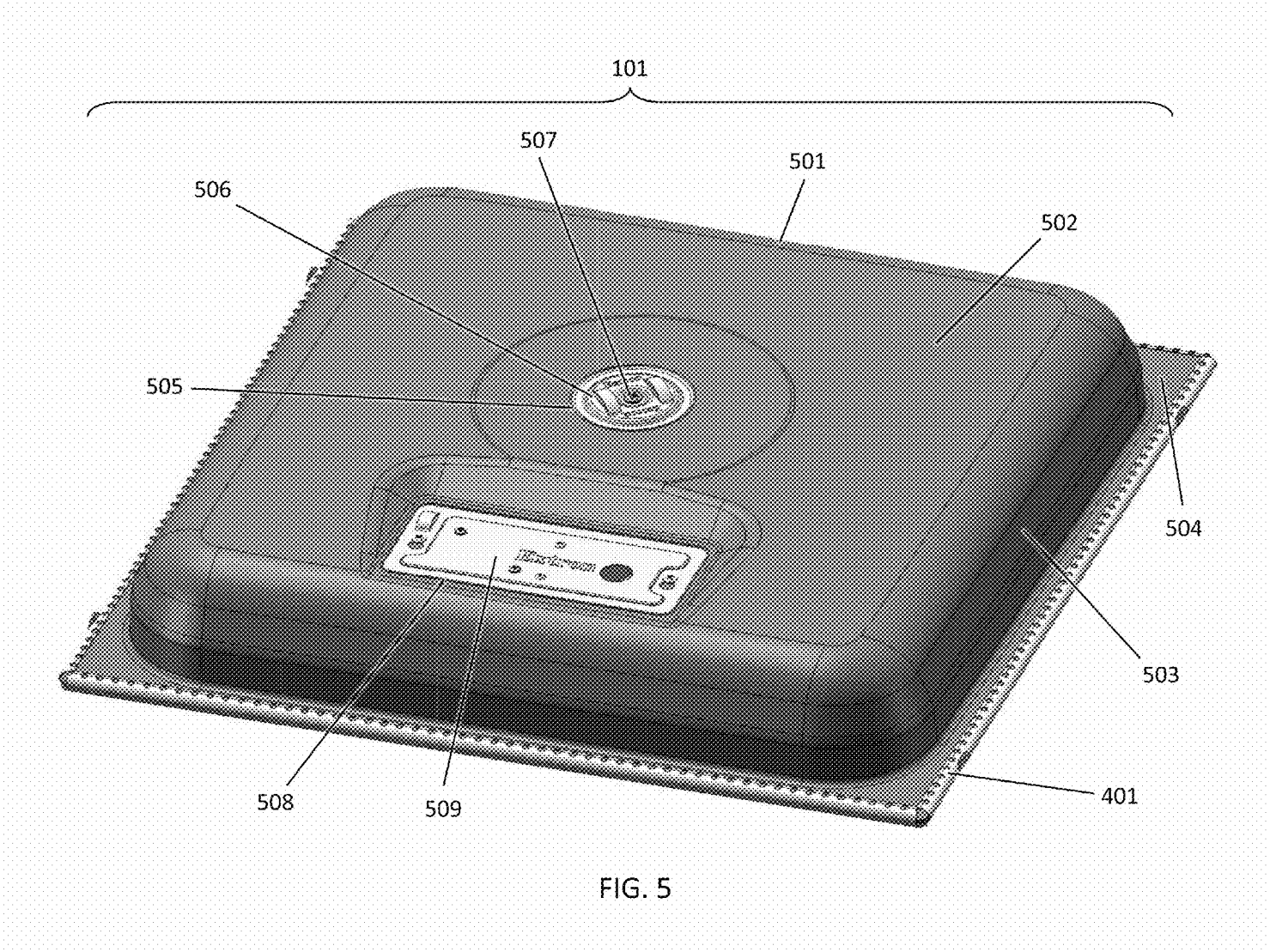
FIG. 5 is an axonometric projection of a loudspeaker assembly in accordance with at least one embodiment, as viewed from a rear perspective.

FIG. 5 is an axonometric projection of a loudspeaker assembly in accordance with at least one embodiment, as viewed from a rear perspective. In the embodiment of FIG. 5, a back box 501 is placed over the rear portion of the loudspeaker assembly 101. In accordance with at least one embodiment, back box 501 provides thermal insulation. In one or more embodiments, back box 501 is configured to comply with fire protection requirements such as fire codes and industry standards, such as UL or Intertek standards. In one or more embodiments, back box 501 provides an additional acoustic barrier, preventing sound from traveling out of the back of the speaker enclosure. In one or more embodiments, back box 501 is formed of a fire-resistant material, such as mineral fiber, glass fiber, or aramid fiber. Alternatively, back box 501 may be formed of a polymer material, a composite material, a metal, or any other suitable material. In accordance with at least one embodiment, back box 501 is a standard 2 foot by 2 foot plenum-rated back box of the type commonly used in heating, ventilation, and air conditioning (HVAC) systems. In one or more embodiments, back box 501 is any standard size imperial or metric back box of the type commonly used in HVAC systems.

In one or more embodiments, back box 501 comprises a top portion 502, a sidewall 503, and an edge portion 504. In one or more embodiments, back box 501 is configured so as to fit over and enclose rear baffle 102, and such that edge portion 504 of back box 501 rests on edge portion 105 of rear baffle 102 when back box 501 is placed over rear baffle 102. In one or more embodiments, grille 401 is crimped about both edge portion 105 of the rear baffle 102 and edge portion 504 of back box 501, thereby fastening back box 501 to rear baffle 102. Alternatively, in one or more embodiments, back box 501 is attached to rear baffle 102 with rivets, screws, nuts and bolts, adhesive, by welding, or by any other suitable attachment method.

In accordance with at least one embodiment, back box 501 comprises an aperture 505 that is configured to substantially line up with aperture 108 of rear baffle 102 and attachment mechanism 212 of first driver 207 after back box 501 is mounted to rear baffle 102 such that a mounting plate 506 can be secured to first driver 207 by means of a screw 507 or other fastener that can be secured to attachment mechanism 212 of first driver 207. Mounting plate 506 provides an attachment point for securely attaching the first driver 207, and hence loudspeaker assembly 101, which is securely attached to first driver 207, to a structural support. In this manner, driver 207 acts as an integrated load-bearing-capable member of loudspeaker assembly 101. In accordance with at least one embodiment, screw 507 is a ¼ inch by 20 TPI machine screw. In accordance with at least one embodiment, aperture 505 is ¼ inch in diameter to accommodate screw 507.

In accordance with at least one embodiment, top portion 502 of back box 501 comprises an aperture 508 that is configured to provide access to recessed compartment 109 of rear baffle 102 when back box 501 is mounted to rear baffle 102. In one or more embodiments, a cover 509 is removably mounted to back box 501 so as to cover aperture 508.

Figure 6:
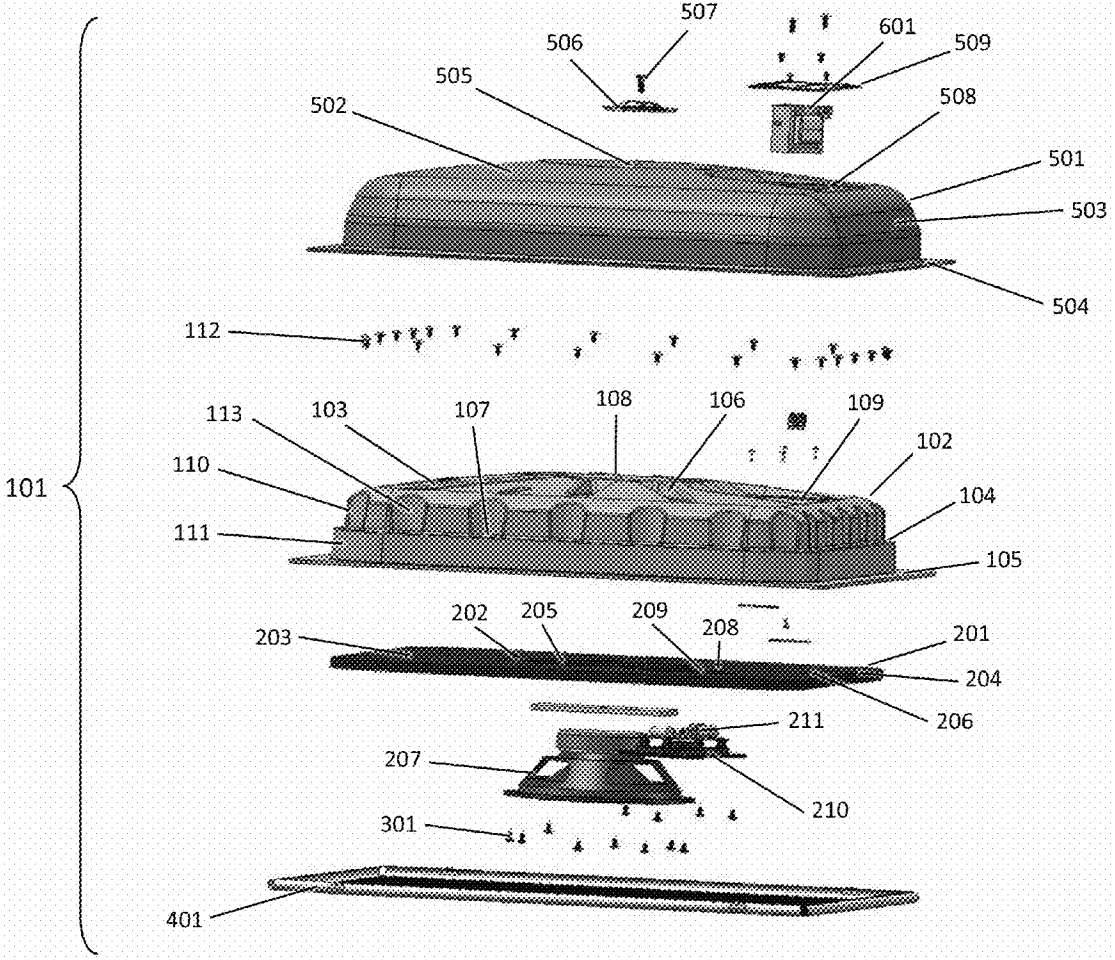
FIG. 6 is an assembly drawing showing how the components of a loudspeaker assembly are assembled in accordance with at least one embodiment.

FIG. 6 is an assembly drawing showing how the components of a loudspeaker assembly 101 as shown in FIGS. 1-5 are assembled in accordance with at least one embodiment. In the embodiment of FIG. 6, an electrical assembly 601 is mounted in recessed compartment 109. Electrical assembly 601 may contain electrical terminals, a transformer, an amplifier, attenuators, volume controls, tone controls, active or passive crossover networks, a digital audio interface connected to a computer network, a radio receiver, or any other assembly of electronics.

Figure 7:
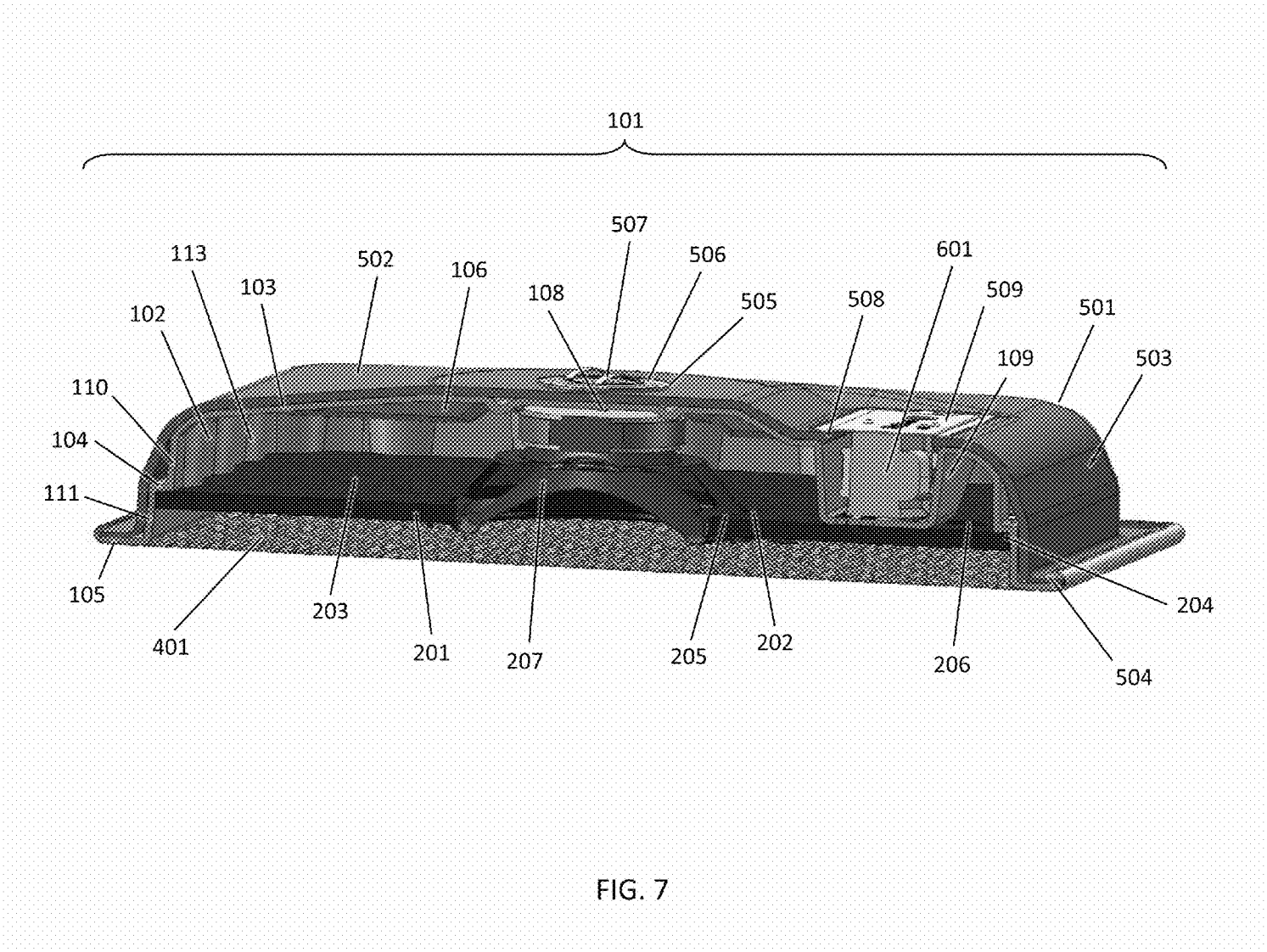
FIG. 7 is a cross-sectional view of an assembled loudspeaker assembly in accordance with at least one embodiment.

FIG. 7 is a cross-sectional view of an assembled loudspeaker assembly 101 in accordance with at least one embodiment.

Figure 8:
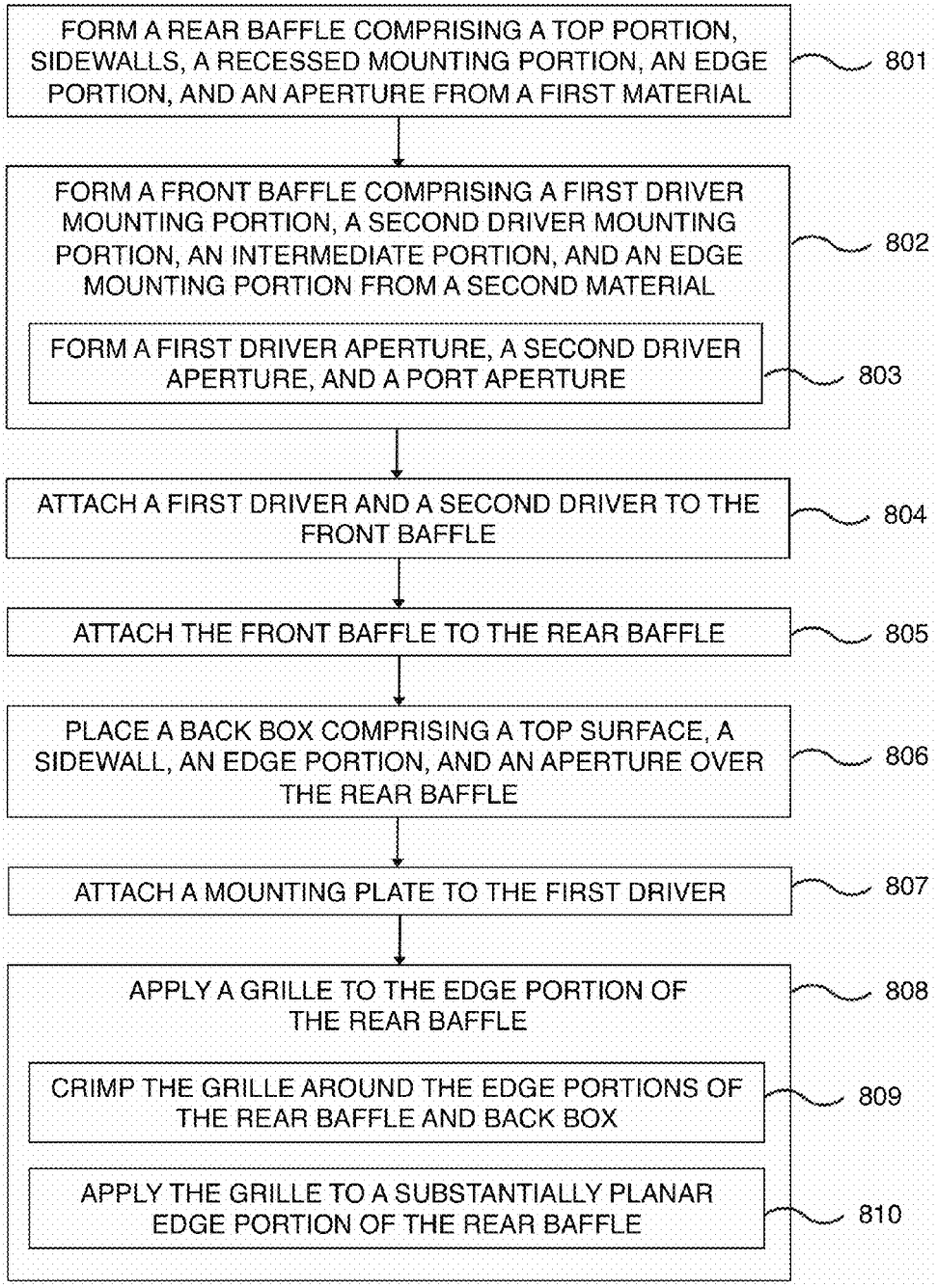
FIG. 8 is a flow chart showing method steps of one or more embodiments of the invention.

FIG. 8 is a flow chart illustrating the steps of assembling a loudspeaker assembly in accordance with at least one embodiment. At step 801, a rear baffle comprising a top portion, sidewalls, a recessed mounting portion, an edge portion, and an aperture is formed from a first material. At step 802, a front baffle comprising a first driver mounting portion, a second driver mounting portion, an intermediate portion, and an edge mounting portion is formed from a second material, which may be the same as or different from the first material. At step 803, a first driver aperture is formed in the first driver mounting portion, a second driver aperture is formed in the second driver mounting portion, and a port aperture is formed in the intermediate portion. In one or more embodiments, step 803 may be included in step 802. At step 804, a first driver is attached to the front baffle proximate to the first driver aperture and a second driver is attached to the front baffle proximate to the second driver aperture. At step 805, the edge mounting portion of the front baffle is attached to the recessed mounting portion of the rear baffle, thereby securing the front baffle, complete with the first and second drivers, to the rear baffle. At step 806, a back box comprising a top surface, a sidewall, an edge portion, and an aperture is placed over the rear baffle. At step 807, a mounting plate is attached to the first driver by means of a fastener that passes through the apertures of the back box and the rear baffle. At step 808, a grille is applied to the edge portion of the rear baffle.

In accordance with at least one embodiment, step 808 further comprises step 809. At step 809, the grille is crimped around the edge portions of the rear baffle and back box, thereby binding the grille to the rear baffle and back box and binding the rear baffle and back box together. In accordance with at least one embodiment, step 808 further comprises step 810. In step 810, the grille is applied to a substantially planar edge portion of the rear baffle, wherein the substantially planar edge portion surrounds an elevated portion of the rear baffle, the elevated portion of the rear baffle surrounding the front baffle. In accordance with at least one embodiment, the substantially planar edge portion of the rear baffle lies substantially in a first plane and the elevated portion of the rear baffle lies substantially in a second plane, the first plane being substantially parallel to the second plane.

The shape, dimensions, and relative positions of rear baffle 102 and front baffle 201 can be varied to vary the frequency response characteristics of loudspeaker assembly 101. The relationships between the driver characteristics, the front baffle 201 characteristics, the rear baffle 102 characteristics, the interior volume of the rear baffle 102, and the size of the port aperture 206 can be varied to vary the frequency response and efficiency of loudspeaker assembly 101. In one or more embodiments, port aperture 206 is smaller than first driver aperture 205. In one or more embodiments, port aperture 206 is of equal or larger size than first driver aperture 205. In one or more embodiments, first driver mounting portion 202 is centered in front baffle 201 to minimize bending moments across the surface of front baffle 201, significantly reducing vibration of front baffle 201 and distortion arising from such vibration.

The shapes and dimensions of cavities defined by the shapes and relative positions of rear baffle 102 and front baffle 201 can be varied by altering the shapes and dimensions of rear baffle 102 and front baffle 201. For example, a driver cavity formed by front baffle 201 and rear baffle 102 defines a volume around first driver 207 mounted to first driver mounting portion 202 and second driver 210 mounted to second driver mounting portion 208. Not only can the volume of the driver cavity be varied, but its shape can also be varied so as to vary the propagation of sound waves from first and second drivers 207 and 210 to port aperture 206.

In one or more embodiments, loudspeaker assembly 101 is adapted to be installed in a surface, such as a ceiling or wall. In one or more embodiments, loudspeaker assembly 101 is configured to be installed in surfaces such as ceilings and walls with minimal modification of the surface. In one or more embodiments, loudspeaker assembly 101 is formed into sizes and shapes that comply with industry standards, such as standard sizes of suspended ceiling tiles. In one or more embodiments, loudspeaker assembly 101 is configured to have the size of a standard 2 by 2 foot ceiling tile and to be installed in an existing suspended ceiling by removing an existing ceiling tile, routing external wiring to the location where the ceiling tile was removed, connecting the external wiring to electrical terminals accessible from the exterior of loudspeaker assembly 101 (for example, electrical terminals disposed in recessed compartment 109 of rear baffle 102), and inserting loudspeaker assembly l01 to either fully or partially replace the removed ceiling tile. If appropriate, mounting plate 506 may be secured to a support structure. If necessary, a portion of the removed ceiling tile may be trimmed and replaced to complete the installation. In accordance with at least one embodiment, loudspeaker assembly 101 is mounted in a drywall surface.

Because weight is a consideration for a suspended lay-in loudspeaker assembly, it is desirable to make such a loudspeaker assembly as light as practicable without sacrificing sound quality, regulatory compliance, mechanical stability, or aesthetics. Securely attaching a three-dimensional rear baffle 102 formed from a relatively flexible material to a generally planar front baffle 201 formed from a relatively stiff material allows a relatively lightweight loudspeaker assembly 101 to be constructed without sacrificing rigidity. Alternatively, similar advantages are obtained by forming rear baffle 102 from a relatively stiff material and forming front baffle 201 from a lighter but less stiff material.

Further, recessing front baffle 201 into rear baffle 102 as in one or more embodiments provides several advantages. One advantage, for example, is that the speaker drivers are neither mounted to nor in contact with grille 401, which improves aesthetic appearance by avoiding the need for mounting hardware, such as rivets, to be visible on grille 401, and prevents vibrations that may be caused by contact of the speaker drivers with the grille. Further, by mounting the drivers to front baffle 201, which is recessed into and securely attached to rear baffle 102, and by securing rear baffle 102 to the rear of front driver 207, a significantly rigid structure is formed that reduces vibration of grille 401 and top portion 103 of rear baffle 102 and distortion arising from such vibration. Furthermore, by not using grille 401 as a weight bearing element, the chance of grille 401 sagging under the weight of the drivers is reduced. Recessing recessed compartment 109 into rear baffle 102 also helps lower the overall profile of loudspeaker assembly 101. Thus, a loudspeaker assembly of lower profile can be provided. Such lower profile loudspeaker assemblies can be installed in locations where installation might not be possible with higher profile loudspeaker assemblies. By using small, highly efficient drivers, one or more embodiments provide a low profile loudspeaker assembly that can be installed in spaces that have limited vertical clearance.

One or more embodiments of loudspeaker assembly 101 are compatible with existing surfaces, such as existing ceiling tiles. For example, a 2×2 foot loudspeaker assembly can be implemented to replace a standard 2×2 foot ceiling tile or half of a standard 2×4 foot ceiling tile. If more volume and/or power handling capability is desired, multiple loudspeaker assemblies, such as multiple 2×2 loudspeaker assemblies, can be ganged together and installed adjacent to one another within the space obtained by removing one or more ceiling tiles. In one or more embodiments, additional ceiling supports are placed between the multiple loudspeaker assemblies.

Thus, a method and apparatus for a loudspeaker assembly is described. Although the present invention has been described with respect to certain specific embodiments, it will be clear to those skilled in the art that the inventive features of the present invention are applicable to other embodiments as well, all of which are intended to fall within the scope of the present invention.

What is claimed is:

1. A method for assembling a loudspeaker assembly comprising the steps of:

forming a rear baffle comprising an open bottom portion, a top portion, sidewalls, and a recessed mounting portion from a relatively flexible first polymer material;

forming a front baffle comprising a first driver aperture from a relatively stiff second material;

mounting a first driver proximate to said first driver aperture;

mounting said front baffle to said recessed mounting portion of said rear baffle such that an entirety of said front baffle is recessed within said rear baffle spaced apart from said open bottom portion;

mounting said rear baffle to said first driver such that said first driver, said front baffle and said rear baffle form a substantially rigid assembly.

2. The method of claim 1 wherein the attachment of said front baffle to said rear baffle increases rigidity of said loudspeaker assembly.

3. The method of claim 1 further comprising the steps of:

forming a second driver aperture in said front baffle; and mounting a second driver proximate to said second driver aperture.

4. The method of claim 1 further comprising the step of forming a port aperture in said front baffle.

5. The method of claim 1 further comprising the step of attaching a back box to said rear baffle.

6. The method of claim 1 further comprising the step of attaching a mounting plate to said first driver with a fastener that passes through an aperture in said rear baffle.

7. A loudspeaker assembly comprising:

a rear baffle formed of a relatively flexible first polymer material comprising an open bottom portion, a top portion, sidewalls, an edge portion and a recessed mounting portion;

a front baffle formed of a relatively stiff second material comprising a first driver aperture and an edge mounting portion, said edge mounting portion of said front baffle being attached to said recessed mounting portion of said rear baffle such that an entirety of said front baffle is recessed within said rear baffle spaced apart from said open bottom portion; and a first driver attached to said front baffle proximate to said first driver aperture and to said rear baffle.

8. The loudspeaker assembly of claim 7 wherein said first baffle comprises a second driver aperture and further comprising a second driver attached to said front baffle proximate to said second driver aperture.

9. The loudspeaker assembly of claim 7 wherein said front baffle further comprises a port aperture.

10. The loudspeaker assembly of claim 7 further comprising a back box attached to said rear baffle.

11. The loudspeaker assembly of claim 7 further comprising a mounting plate attached to said first driver with a fastener that passes through an aperture in said rear baffle.

12. A loudspeaker assembly comprising:

a rear baffle formed from a first material comprising an open bottom portion, a top portion, sidewalls, a recessed mounting portion, and an edge portion;

a front baffle formed from a second material comprising a first driver aperture, a second driver aperture, an edge mounting portion, and an intermediate portion, said edge mounting portion mounted to said recessed mounting portion of said rear baffle such that an entirety of said front baffle is recessed within said rear baffle spaced apart from said open bottom portion;

a first driver mounted to said front baffle proximate to said first driver aperture and to said rear baffle;

a second driver mounted to said front baffle proximate to said second driver aperture;

a mounting plate attached to said first driver through an aperture in said rear baffle.

13. The loudspeaker assembly of claim 12 further comprising a grille covering said open bottom portion of said rear baffle.

14. The loudspeaker assembly of claim 12 further comprising a back box mounted to said rear baffle.

* * * * *